US009934641B2

(12) United States Patent
Saiki

(10) Patent No.: US 9,934,641 B2
(45) Date of Patent: Apr. 3, 2018

(54) AUTOMATIC TRANSACTION DEVICE

(71) Applicant: Oki Electric Industry Co., Ltd., Tokyo (JP)

(72) Inventor: Yoshihiro Saiki, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 15/503,708

(22) PCT Filed: Jun. 4, 2015

(86) PCT No.: PCT/JP2015/066245

§ 371 (c)(1),
(2) Date: Feb. 13, 2017

(87) PCT Pub. No.: WO2016/056273

PCT Pub. Date: Apr. 14, 2016

(65) Prior Publication Data

US 2017/0270736 A1 Sep. 21, 2017

(30) Foreign Application Priority Data

Oct. 10, 2014 (JP) ..... 2014-209183

(51) Int. Cl.
*G07F 9/02* (2006.01)
*G07D 11/00* (2006.01)

(52) U.S. Cl.
CPC ..... *G07D 11/0018* (2013.01); *G07D 11/0048* (2013.01); *G07F 9/02* (2013.01)

(58) Field of Classification Search
CPC ..... G07D 11/0003; G07D 11/0018; G07D 11/0033; G07D 11/006; G07D 11/0054; G07D 13/00; G07D 2211/00; G07F 9/02; G07F 9/10
See application file for complete search history.

(56) References Cited

U.S. PATENT DOCUMENTS

| | | | | |
|---|---|---|---|---|
| 6,334,610 | B1 * | 1/2002 | Minamishin | B65H 1/28 271/126 |
| 7,497,339 | B2 * | 3/2009 | Nagura | G07D 11/0018 194/206 |
| 9,401,062 | B2 * | 7/2016 | Koide | G07D 11/0042 |
| 2013/0015035 | A1 * | 1/2013 | Tanaka | G07D 11/0018 194/206 |

FOREIGN PATENT DOCUMENTS

| | | | |
|---|---|---|---|
| JP | H08-44935 | A | 2/1996 |
| JP | 2003-067808 | A | 3/2003 |
| JP | 2006-313398 | A | 11/2006 |

* cited by examiner

*Primary Examiner* — Mark J Beauchaine

(74) *Attorney, Agent, or Firm* — Rabin & Berdo, P.C.

(57) ABSTRACT

An automatic transaction device includes: a customer service port that accumulates and holds bills so as to be accessible from a customer side; a shutter that closes a deposit/withdrawal port of the customer service port; a sensor that detects an abnormality of the shutter; a bill holding unit that holds accumulated bills, and changes a state in the customer service port from a state in which the bills can be accessed from the customer side to an inaccessible state; and a control unit that controls a change of state of the bill holding unit and an opening and closing operation of the shutter, wherein, in a case in which an abnormality of the shutter is detected, the control unit changes the state of the bill holding unit to the inaccessible state from the customer side.

14 Claims, 12 Drawing Sheets

AUTOMATIC TRANSACTION DEVICE

TECHNICAL FIELD

The present application claims the benefit of priority of Japanese Patent Application No. 2014-209183, filed in Japan on Oct. 10, 2014, and the disclosures thereof are incorporated herein by reference in their entirety. The present invention relates to an automatic transaction device that is installed in a bank, a convenience store, and or other financial institution.

BACKGROUND ART

Conventionally, an automatic transaction device carries out bill deposit and withdrawal transactions by a customer's operation. The automatic transaction device holds bills for withdrawal in a cartridge storing bills of a particular denomination, and bills for withdrawal are discharged to be fed out through a customer service port from the cartridge depending on the payment amount. When a shutter opens, the customer may get bills in the customer service port. A customer service port of the automatic transaction device includes a bill accumulating portion for accumulating the withdrawal bills, a customer side shutter, and a device side shutter. When bills are delivered to the customer, both the customer side shutter and the device side shutter are opened to allow the customer to extract the bills.

On the other hand, recently, bills discharged into the customer service port are sometimes taken out illegally due to the failure or illegal operation of the shutter in this customer service port. In this regard, Japanese Patent Application Laid-Open (JP-A) No. 2006-313398 discloses a technique, at the time of payment transaction of bills, for preventing illegal transactions that may occur when a shutter of a customer service port is not open. In JP-A No. 2006-313398, it is described that, when control to open the shutter has been carried out but a sensor detects that the shutter has not been opened, bills in the customer service port are taken into the device.

Furthermore, JP-A No. 2003-67808 discloses a technique, in an automatic transaction device which performs counting of withdrawal bills at the same time as communicating with a host computer, for preventing theft of the bills during the counting. In JP-A No. 2003-67808, it is described that a customer service port is provided with a dual shutter, including a shutter at the inside and a shutter at the outside. It is described that when it is detected that the outer shutter has been open during the counting operation of the withdrawal bills, the counting operation is stopped and the bills accumulated in the customer service port are taken into the device.

SUMMARY OF INVENTION

Technical Problem

However, in a conventional automatic transaction device including a customer side shutter and a device side shutter, there have been cases in which the customer side shutter is made not to open by an unauthorized person by using glue. In this case, there has been instances of legitimate customers, who do not know that the customer side shutter has been tampered with, noticing that the shutter does not open during a payment transaction and leaving their place to inform a clerk. Then, if the unauthorized person breaks the customer side shutter open, the unauthorized person may readily access bills in the customer service port since the device side shutter is open.

Furthermore, the techniques according to JP-A Nos. 2006-313398 and 2003-67808 are techniques in which, when a sensor detects an abnormality, the automatic transaction device discontinues the transaction and takes withdrawal bills that have been accumulated in the customer service port into a temporary storage unit in the device. However, when a customer resumes the transaction, the customer must operate from the beginning, which is a burden to the customer.

The present invention is to prevent easy access from a customer side, even if there is an abnormality in the opening (open abnormality) of a shutter of a customer service port at the time of withdrawal, and further provides an automatic transaction device in which resumption of a transaction is not burdensome to a customer.

Solution to Problem

An automatic transaction device according to an aspect of the present invention includes: a customer service port that accumulates and holds bills so as to be accessible from a customer side; a shutter that closes a deposit/withdrawal port of the customer service port; a sensor that detects an abnormality of the shutter; a bill holding unit that holds accumulated bills, and changes a state in the customer service port from a state in which the bills can be accessed from the customer side to an inaccessible state; and a control unit that controls a change of state of the bill holding unit and an opening and closing operation of the shutter, wherein, in a case in which an abnormality of the shutter is detected, the control unit changes the state of the bill holding unit to the inaccessible state from the customer side.

Effects of Invention

According to the present aspect having the above configuration, when an abnormality is detected in the shutter, since the control unit changes the bill holding unit to a state in which access from the customer side is impossible, at the time of withdrawal, even if there is an open abnormality of the shutter of the customer service port, the bill holding unit cannot be easily accessed from the customer side. Furthermore, the present aspect enables provision of an automatic transaction device in which resumption of a transaction is not burdensome to the customer.

DESCRIPTION OF EMBODIMENTS

First Embodiment

Figure 1:
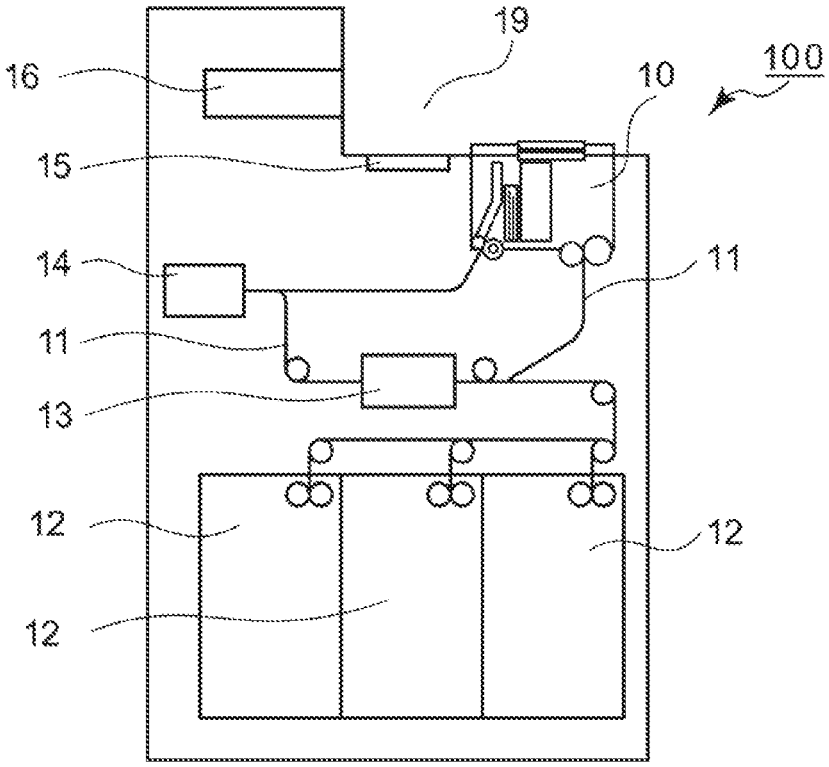
FIG. 1 illustrates a block diagram of a configuration of an automatic transaction device according to a first embodiment.

Hereinafter, the first embodiment is described. FIG. 1 illustrates a block diagram of a configuration of the automatic transaction device according to the first embodiment. The automatic transaction device 100 includes a customer operation unit 19 at the front. The customer operation unit 19 includes a customer service port 10, an operation display unit 15, and a card statement processing unit 16. As described below, the customer service port 10 of the present embodiment discharges bills to a customer, and accepts bills inserted by the customer. Inside the automatic transaction device 100, the customer service port 10 is connected to one end of a bill conveyance path 11, and the other ends of the bill conveyance path 11 are coupled to bill storages 12 for storing plural types of bills. A bill classification unit 13 for determining the denominations and authenticity of bills, and a temporary storage unit 14 for temporarily storing the bills having passed through the bill classification unit 13 are located on the bill conveyance path 11.

At the time of withdrawal, withdrawal bills fed out one by one from any of the bill storages 12 are conveyed on the bill conveyance path 11, and the denominations and authenticity are determined by the bill classification unit 13. Thereafter, the withdrawal bills are stored in the temporary storage 14, are accumulated one by one at the customer service port 10 and held therein. Further, at the time of deposit, deposit bills inserted in the customer service port 10 are fed one by one from the customer service port 10, conveyed on the bill conveyance path 11, and the denominations and authenticity thereof are determined by the bill classification unit 13. Subsequently, after there is a deposit instruction of the customer, the deposit bills are accommodated in the bill storages 12 provided for each of the denominations.

Figure 2:
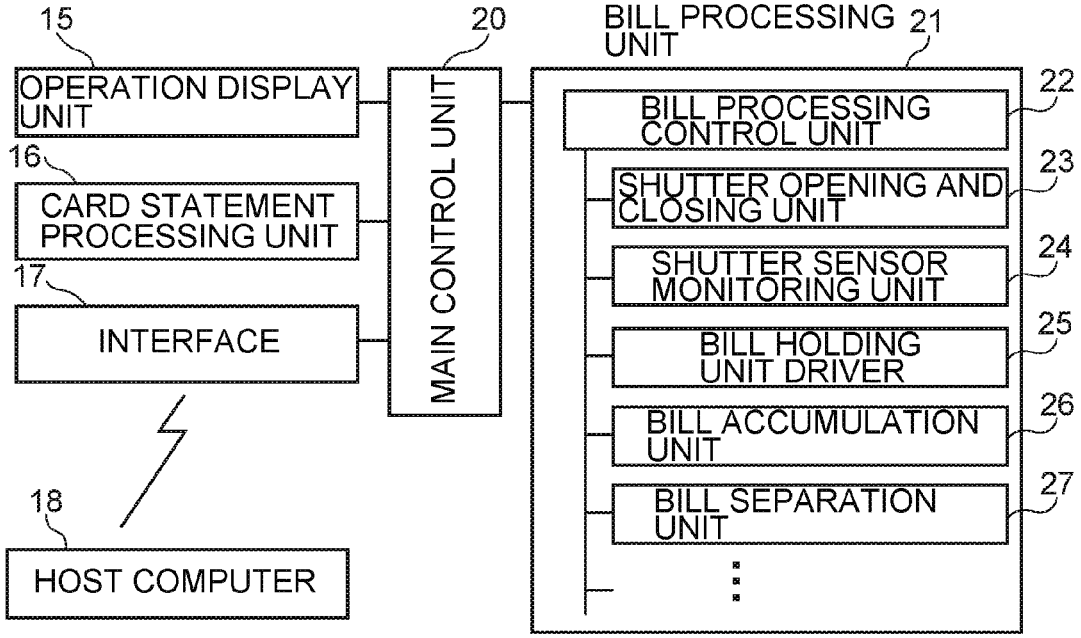
FIG. 2 illustrates a block diagram of a control system of the automatic transaction device according to the first embodiment.

FIG. 2 illustrates a block diagram of a control system of the automatic transaction device according to the first embodiment. FIG. 2 illustrates only the functions related to the present embodiment. A main control unit 20 of the automatic transaction device 100 controls each part of the automatic transaction device 100. The main control unit 20 transmits and receives data relating to transactions with a host computer 18, and performs processing of data relating to transactions. Therefore, the main control unit 20 includes a CPU and memory (not shown in the drawings).

The operation display unit 15 includes a display function that displays guidance about the transaction to the customer, and an input function that accepts an input of an instruction or selection from a customer. When a customer initiates a transaction, the card statement processing unit 16 accepts a cash card, and reads the card information. When the transaction is completed, the card statement processing unit 16 returns the cash card to the customer, and issues a statement of the transaction. An interface 17 is connected to the host computer 18 in a calculation center of a financial institution, and transmits and receives necessary data between the host computer 18 and the automatic transaction device 100.

For withdrawal bills, a bill processing unit 21 performs conveyance and accumulation from the bill storages 12 to the customer service port 10. For deposit bills, the bill processing unit 21 performs feed-out from the customer service port 10, and performs conveyance and accommodation thereof. A bill processing control unit 22 controls each part of the bill processing unit 21. A shutter opening and closing unit 23 drives the opening and closing of a customer side shutter 2 and a device side shutter 3, which are described below. A shutter sensor monitoring unit 24 monitors the on-off of a shutter sensor 4 to detect the opening and closing of the customer side shutter 2 and the device side shutter 3. In the present embodiment, when the shutter sensor 4 does not detect an opening despite the shutter opening and closing unit 23 having been driven to open the customer side shutter 2, the bill processing control unit 22 determines that there is an open abnormality as described below.

A bill press unit driver 25 drives the movement of bill press units 5-1 and 5-2, which are the bill holding unit and are described below. A bill accumulation unit 26 performs rotation of a pair of bill accumulating rollers 6-1 and 6-2 of a bill accumulation port 6 that is described below, and performs accumulation of withdrawal bills B at the customer service port 10. A bill separation unit 27 performs rotation of a pair of bill separating rollers 7-1 and 7-2 in a bill separation port 7 that is described below, and performs separation and feed-out of deposit bills from the customer service port 10. Explanation of other elements of the bill processing unit 21 is omitted.

Figure 3:
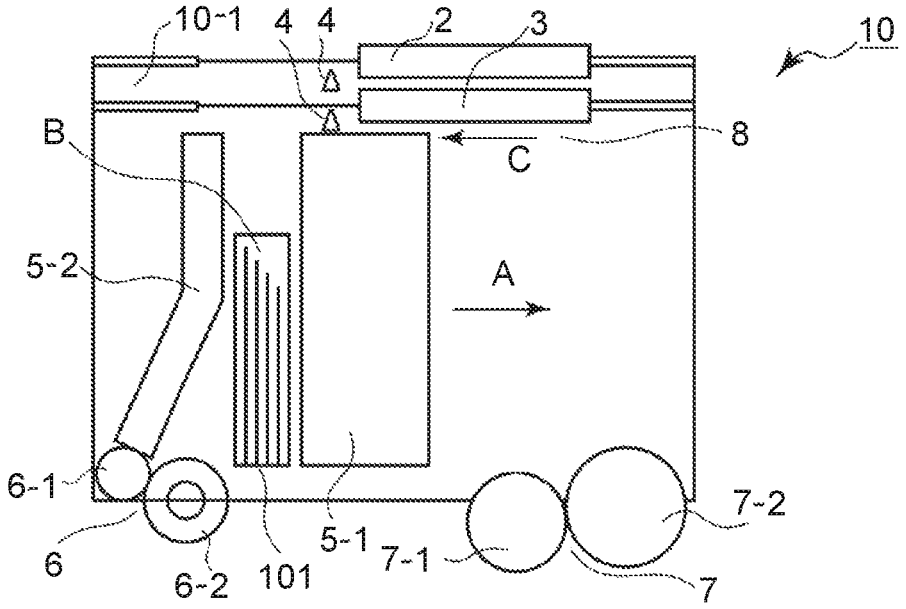
FIG. 3 is an explanatory diagram illustrating structures of the customer service port of the automatic transaction device according to the first embodiment.

FIG. 3 is an explanatory diagram illustrating structures of the customer service port of the automatic transaction device according to the first embodiment. FIG. 3 illustrates a state in which the withdrawal bills B are held and accumulated in an accumulation position 101 that is described later. The customer service port 10 is a rectangular parallelepiped box, and is provided in a housing 10-1 of the customer operation unit 19 of the automatic transaction device 100, such that the upper surface of the customer service port 10 is located at the housing 10-1. In FIG. 3, when, as seen from a customer, the right side is defined as a front side and the left side is defined as a back side, the automatic transaction device 100 includes a dual shutter constituted from the customer side shutter 2 and the device side shutter 3 at the front side, as seen from a customer, in the upper surface of the customer service port 10. The customer side shutter 2 is provided at the outside of the device side shutter 3. The device side shutter 3 is provided at the inner side of the customer side shutter 2. The customer side shutter 2 and the device side shutter 3 close a deposit/withdrawal port 8 of the customer service port 10. The customer side shutter 2 and the device side shutter 3 open by moving parallel to the housing 10-1 from the front side to the back side as seen from a customer, as shown by an arrow C, and close by moving in the opposite direction.

As described below, at the time of withdrawal, the customer side shutter 2 and the device side shutter 3 open at the same time when the withdrawal bills B can be taken out by the customer. At the time of deposit, the customer side shutter 2 and the device side shutter 3 open at the same time just before the deposit bills are inserted into the customer service port 10, and close at the same time after the completion of the insertion of the deposit bills into the customer service port 10. A bill sensor (not shown) detects insertion and extraction of the bills. The opening and closing of the customer side shutter 2 and the device shutter 3 are detected by the shutter sensor 4, and are monitored by the shutter sensor monitoring unit 24. The opening and closing of the customer side shutter 2 and device side shutter 3 are performed by the driving of the shutter opening and closing unit 23. Although the opening and closing of the customer side shutter 2 and device side shutter 3 are performed at the same time, drive systems therefor exist independently. Therefore, even if the customer side shutter 2 is not opened by any external force, the device side shutter 3 is opened without the influence of the customer side shutter 2.

The customer side shutter 2 and the device side shutter 3 do not cover the entire area of the upper surface of the customer service port 10, but cover half the area or less at the front side. The remaining area, i.e., the back side of the customer service port 10 is covered by the housing 10-1. At the time of withdrawal, when the customer side shutter 2 and the device side shutter 3 open normally, only the half or less region at the front side of the inside region of the customer service port 10, including a bill delivery position 102 that is described below, can be accessed from the customer side. In this regard, "access to bills from the customer side" refers to bills being accessed by the customer using hands or tools and, as a result, the customer being able to carry away or receive the bills.

The customer service port 10 has the bill accumulation port 6 therein. The bill accumulation port 6 accumulates the withdrawal bills B conveyed from the bill conveyance path 11 at the accumulation position 101 of the customer service port 10. The bill accumulation port 6 is a bottom surface of the customer service port 10, and is provided at the back side, as seen from a customer, of the lower part of the housing 10-1. The bill accumulation port 6 includes the pair of bill accumulation rollers 6-1 and 6-2 for accumulating the withdrawal bills B. The pair of bill accumulation rollers 6-1 and 6-2 is driven by the bill accumulation unit 26, and accumulates the withdrawal bills B one by one at the accumulation position 101.

At this time, the withdrawal bills B are sequentially accumulated in the thickness direction of the withdrawal bills B between the bill press units 5-1 and 5-2, with the long sides of the rectangle bills in a lateral direction, and the short sides in a vertical direction. The accumulation position 101 of the withdrawal bills B is provided at the most back side of the customer service port 10 as seen from the customer side. The accumulation position 101 is between the bill press units 5-1 and 5-2. When the withdrawal bills B are at the accumulation position 101, access from the customer side to the withdrawal bills B is impossible since the customer side shutter 2 and the device side shutter 3 are still closed.

The bill press units 5-1 and 5-2 are provided inside the customer service port 10. The bill press units 5-1 and 5-2 are bill holding units for holding the withdrawal bills B by sandwiching the withdrawal bills B that have been accumulated in the accumulation position 101. The bill press units 5-1 and 5-2 include two bill presses 5-1 and 5-2 provided collaterally. The bill press units 5-1 and 5-2 are movable within the customer service port 10 in an arrow A direction and the opposite direction. In other words, the bill press units 5-1 and 5-2 are provided inside the customer service port 10 such that they can move to-and-fro between the front side and the back side as seen from a customer. When the withdrawal bills B are accumulated, the bill press units 5-1 and 5-2 move to the back side as seen from a customer. In other words, at this time, the bill press units 5-1 and 5-2 move to the accumulation position 101, which is an inaccessible position from the customer side. Further, when the withdrawal bills B are paid-out to the customer, the bill press units 5-1 and 5-2 move to the front side. In other words, the bill press units 5-1 and 5-2 move to the bill delivery position 102 that is described below, which is an accessible position from the customer side.

Figure 4A:
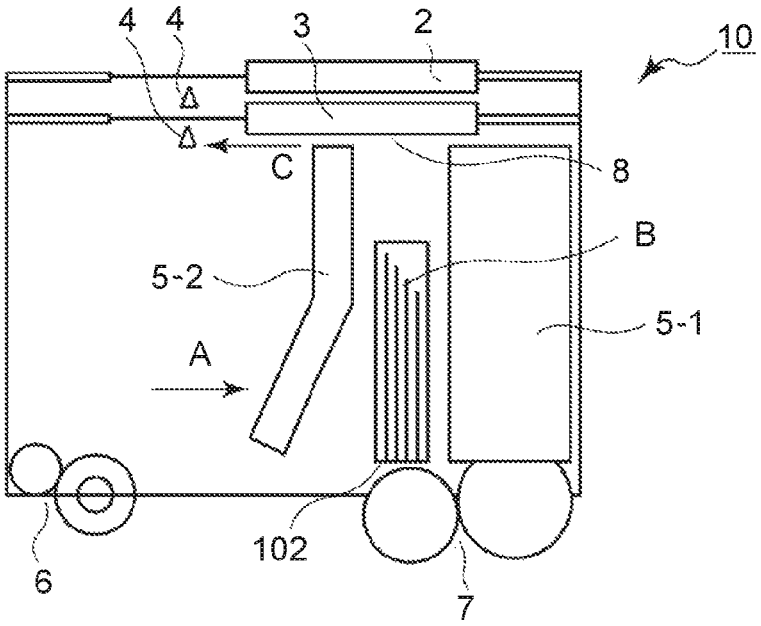
FIG. 4A is an explanatory diagram illustrating the operation in a normal state of a customer service port of the automatic transaction device according to the first embodiment.
Figure 4B:
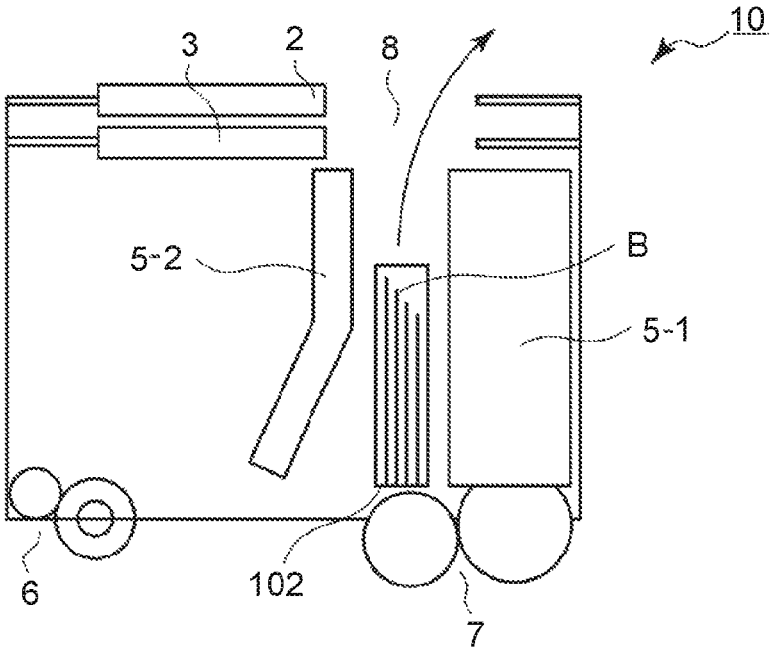
FIG. 4B is an explanatory diagram illustrating the operation in the normal state of the customer service port of the automatic transaction device according to the first embodiment.

FIGS. 4A and 4B are explanatory diagrams that illustrate the operation in the normal state of the customer service port of the automatic transaction device according to the first embodiment. The bill press units 5-1 and 5-2 that have moved in the direction of the arrow A stop at the bill delivery position 102 while holding the withdrawal bills B. FIG. 4A illustrates a state in which the bill press units 5-1 and 5-2 are moved to the bill delivery position 102. As described above, the bill delivery position 102 is a position directly below the customer side shutter 2 and the device side shutter 3 provided at the front side as seen from a customer. In this state, the customer side shutter 2 and the device side shutter 3 are completely closed. This state indicates that preparations to withdraw the withdrawal bills B to the customer are completed.

Then, the customer side shutter 2 and the device side shutter 3 are opened by moving in the direction of an arrow C. FIG. 4B illustrates a state in which the customer side shutter 2 and the device side shutter 3 have been normally and fully opened. Since the customer side shutter 2 and the device side shutter 3, which have been blocking the deposit/withdrawal port 8, have been normally opened, the deposit/withdrawal port 8 of the customer service port 10 is opened. Accordingly, the withdrawal bills B are accessible from the customer side.

Figure 5:
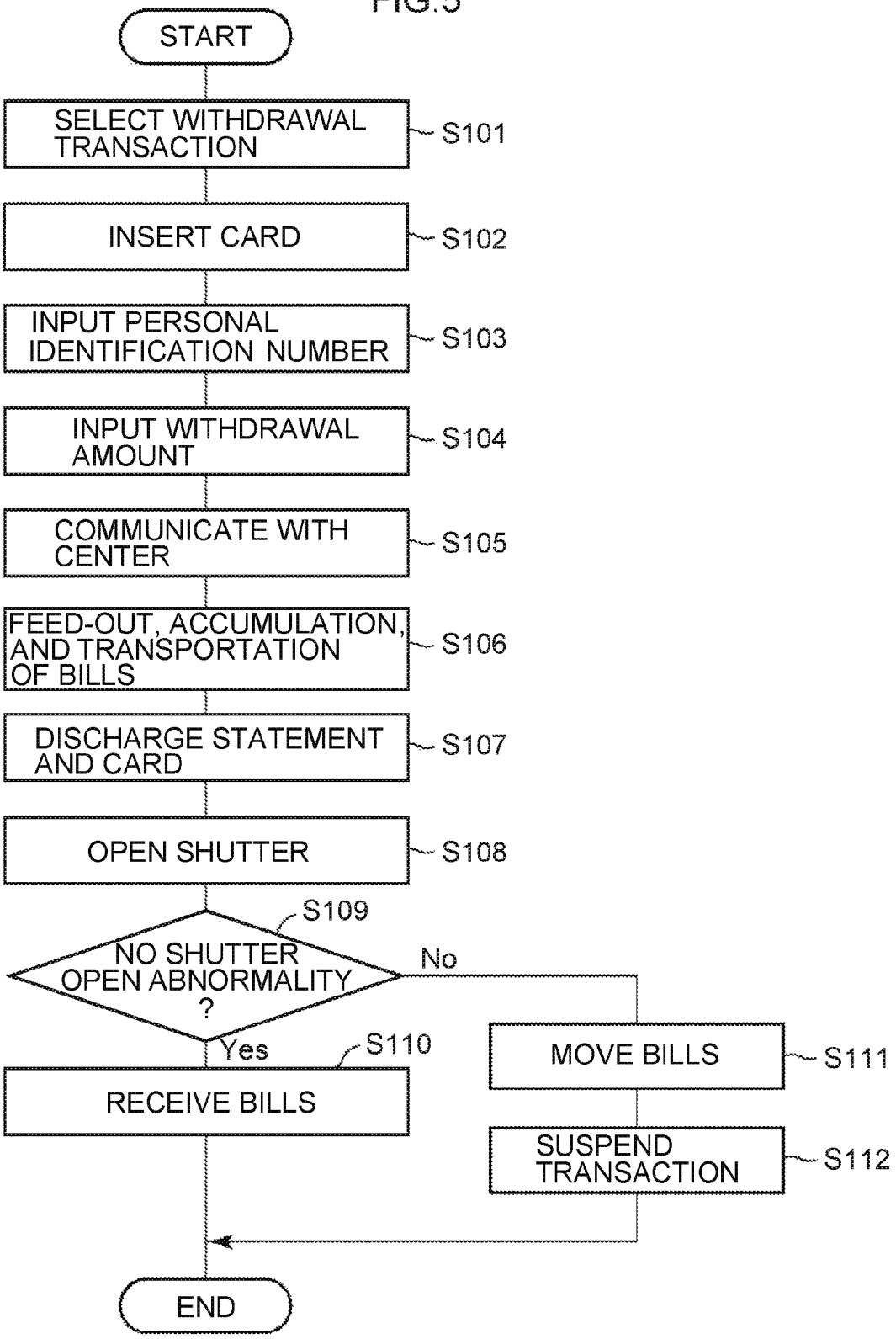
FIG. 5 is a flowchart illustrating the operation of the automatic transaction device according to the first embodiment.

FIG. 5 is a flowchart illustrating the operation of the automatic transaction device according to the first embodiment.

S101: At the start of the transaction, the main control unit 20 instructs the operation display section 15 to display a transaction selection screen (not shown). When the customer selects the withdrawal transaction from the transaction selection screen, the operation display unit 15 detects the selection, and notifies the main control unit 20 of the selection.

S102: Next, the main control unit 20 instructs the operation display unit 15 to display a screen prompting the customer to insert a cash card. After the customer has inserted the cash card (not shown) to the card statement processing unit 16, the card statement processing unit 16 reads the information of the cash card, and notifies the main control unit 20 of the information.

S103: The main control unit 20 instructs the operation display section 15 to display a screen for prompting the customer to input a personal identification number. After the customer enters the personal identification number from the operation display section 15, the operation display section 15 notifies the main control unit 20.

S104: The main control unit 20 instructs the operation display unit 15 to display a screen prompting the customer to input a dispensing amount. After the customer enters the dispensing amount from the operation display unit 15, the operation display unit 15 notifies the main control unit 20.

S105: The main control unit 20 instructs the interface 17 to transmit the transaction information input by the customer to the host computer 18.

S106: After receiving the indication of the transaction authorization from the host computer 18, the main control unit 20 instructs the bill processing controller 22 to perform the withdrawal processing. The bill processing control unit 22 instructs the bill storage 12 to feed out the withdrawal bills that correspond to the withdrawal amount. The withdrawal bills are conveyed along the bill conveyance path 11 and reach the customer service port 10. The bill processing controller 22 instructs the bill accumulation unit 26 to accumulate the bills conveyed along the bill conveyance path 11 at the accumulation position 101 of the customer service port 10, and to hold them. After a predetermined number of withdrawal bills B are accumulated and held at the accumulation position 101 between the bill press units 5-1 and 5-2 of the customer service port 10, the bill processing controller 22 instructs the bill press unit driver 25 to move the bill press units 5-1 and 5-2 in the direction of the arrow A. As shown in FIG. 4A, the bill press units 5-1 and 5-2 that have moved in the direction of the arrow A stop at the bill delivery position 102 while holding the withdrawal bills B. In this state, the process transitions to the next step.

S107: The main control unit 20 instructs the card statement processing unit 16 to discharge the statement of the transactions and the cash card of the customer. The sensor (not shown) detects that the customer has received the statement of the transactions and the cash card.

S108: The main control unit 20 instructs the bill processing control unit 22 to open the customer side shutter 2 and the device side shutter 3 by driving the shutter opening and closing unit 23.

S109: The main control unit 20 instructs the bill processing control unit 22 to monitor whether or not the customer side shutter 2 and the device side shutter 3 have been normally opened using the shutter sensor monitoring unit 24. As shown in FIG. 4B, due to the customer side shutter 2 and the device side shutter 3 being opened normally, the withdrawal bills B become accessible from the customer side. In this case, the process proceeds to step 110.

S110: The main control unit 20 instructs the bill processing control unit 22 to monitor that the customer receives the withdrawal bills B of the customer service port 10 using a bill sensor (not shown). After the customer receives the withdrawal bills B, the process ends.

Figure 6A:
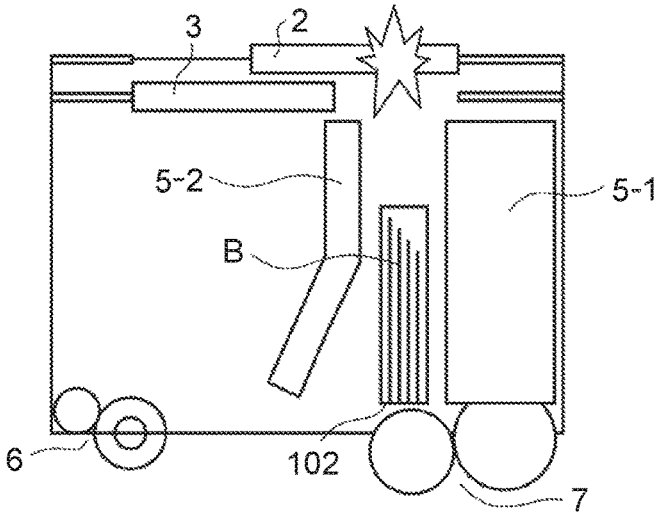
FIG. 6A is an explanatory diagram illustrating the operation in an abnormal state of the customer service port of the automatic transaction device according to the first embodiment.
Figure 6B:
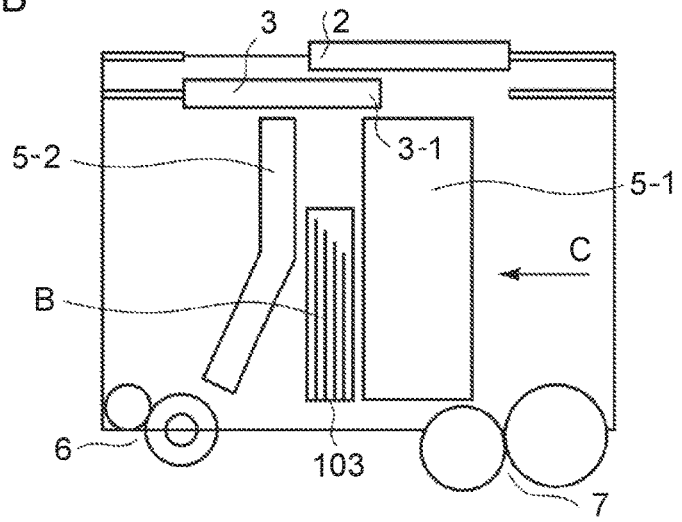
FIG. 6B is an explanatory diagram illustrating the operation in the abnormal state of the customer service port of the automatic transaction device according to the first embodiment.
Figure 6C:
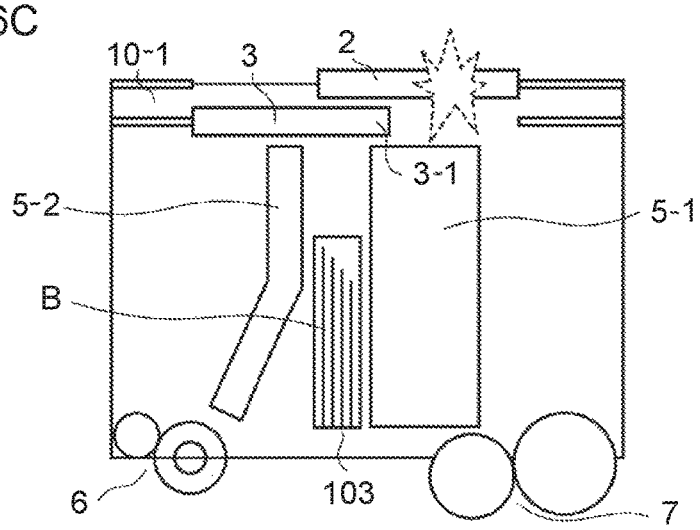
FIG. 6C is an explanatory diagram illustrating the operation in the abnormal state of the customer service port of the automatic transaction device according to the first embodiment.

S111: As a result of detection of the shutter sensor 4, there is a case where the customer side shutter 2 or device side shutter 3 has not opened normally for some reason. FIGS. 6A, 6B, and 6C are explanatory diagrams that illustrate the operation in an abnormal state of the customer service port of the automatic transaction device according to the first embodiment. At this stage, in step 108, the bill processing control unit 22 controls the customer side shutter 2 and the device side shutter 3 to open by driving the shutter opening and closing unit 23.

FIG. 6A illustrates a state in which, despite the shutter opening and closing unit 23 having been driven, the customer side shutter 2 is not open for some reason. In other words, FIG. 6A illustrates a state of open abnormality of the shutter. Since the device side shutter 3 is opened at this time, if an unauthorized person forcibly breaks open the customer side shutter 2, the unauthorized person is able to easily access the withdrawal bills B in the customer service port 10. In other words, the bill press units 5-1 and 5-2 at this time are in a state in which the withdrawal bills B are accessible from the customer side.

Accordingly, in a case in which the shutter sensor 4 detects that the customer side shutter 2 is not open, the shutter sensor monitoring unit 24 notifies the bill processing control unit 22 of the detection result of the shutter sensor 4. In response to this, the bill processing control unit 22 determines that the customer side shutter 2 is in a state of not being open in spite of its opening operation. In other words, the bill processing control unit 22 determines that the shutter is in an abnormal open state, and notifies the main control unit 20 of the abnormal open state of the shutter. In response to this, the main control unit 20 instructs the bill processing control unit 22 to move the bill press units 5-1 and 5-2 in the arrow C direction by the bill press unit driver 25. In other words, the main control unit 20 instructs the bill processing control unit 22 to move the bill press units 5-1 and 5-2 to the retracted position 103, where the withdrawal bills B are retracted, from the bill delivery position 102.

FIG. 6B illustrates a state in which the bill press units 5-1 and 5-2 that are holding and sandwiching the withdrawal bills B are moved to the retracted position 103, which is below the device side shutter 3 in an open state. The retracted position 103, where the withdrawal bills B are retracted, is formed by causing the bill press unit 5-1 at the front side as seen from the customer side and an end portion 3-1 of the device side 3 shutter in the open state to overlap as seen from the customer side. In other words, the bill press units 5-1 and 5-2 at this time are in a state in which the withdrawal bills B are not accessible from the customer side.

In this state, as shown in FIG. 6C, even if a malicious third party other than the customer breaks open the customer side shutter 2, it is impossible to access the withdrawal bills B. This is because the withdrawal bills B, which have been moved to the retracted position 103, are blocked by the bill press unit 5-1 at the front side as seen from a customer and the housing 10-1, particularly by the device side shutter 3 in the opened state. The withdrawal bills B are made inaccessible from the customer side by causing the end portion 3-1 of the device side shutter 3 and the bill press unit 5-1 to overlap. This means that there is a change in state wherein the bill press units 5-1 and 5-2 are at the retracted position 103, which is an inaccessible position from the customer side.

S112: Thereafter, the main control unit 20 determines to suspend the transaction. Then, when resuming the transaction, since the withdrawal bills B are not taken into the device, it is possible for a clerk to hand the withdrawal bills B to the legitimate customer by controlling the main control unit 20.

Specifically, the clerk removes foreign substances and the like at the customer side shutter 2, and confirms that the customer shutter 2 opens and closes properly. After the clerk has confirmed safety, the clerk orders the main controller 20 to resume the withdrawal operation by operating a clerk operating display unit (not shown). In response to this, the main control unit 20 instructs the bill processing control unit 22 to resume the process.

Then, the bill processing control unit 22 instructs the bill press unit driver 25 to move the bill press units 5-1 and 5-2 in the direction of the arrow A, and to move the withdrawal bills B at the retracted position 103 to the bill delivery position 102. Further, the bill processing control unit 22 instructs the shutter opening and closing unit 23 to open the customer side shutter 2 and the device side shutter 3. Thus, the customer may easily receive the withdrawal bills B accumulated at the retracted position 103.

Modified Example of First Embodiment

Figure 7:
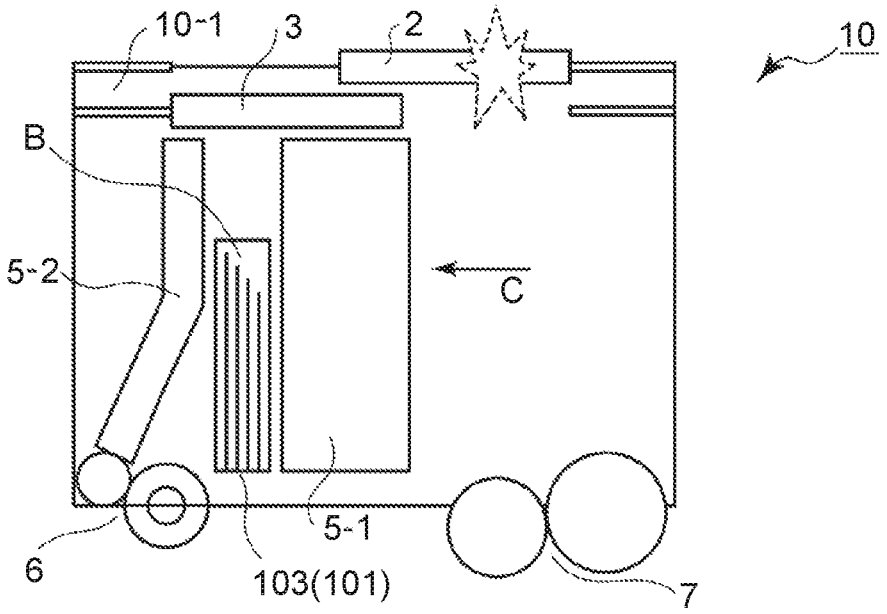
FIG. 7 is an explanatory diagram illustrating a modified example of the customer service port of the automatic transaction device according to the first embodiment.

FIG. 7 is an explanatory diagram illustrating the operation of the abnormal state of the customer service port of the automatic transaction device related to a modified example of the first embodiment. FIG. 7 indicates that the retracted position 103 for retracting the withdrawal bills B may be the same position as the accumulation position 101, described above, where the withdrawal bills B are accumulated. Thus, even if a malicious third party other than the customer breaks open the customer side shutter 2, it is impossible for the third party to access the withdrawal bills B. This is because the withdrawal bills B moved to the retracted position 103 are blocked by the bill press unit 5-1 at the front side as seen from a customer and the housing 10-1, particularly by the device side shutter 3 in the opened state. This also means that there is a change in state wherein the bill press units 5-1 and 5-2 are at the retracted position 103, which is an inaccessible position from the customer side.

As described above, according to the first embodiment, in a case in which it is determined that the customer side shutter 2 has an open abnormality, there is a change in state wherein the bill press units 5-1 and 5-2 as the bill holding units are at the retracted position 103, which is inaccessible position from the customer side. Therefore, at the time of withdrawal, even if there is an open abnormality of the customer side shutter 2 of the customer service port 10, withdrawal bills are made not easily accessible from the customer side. Further, when the transaction resumes, since the customer does not need to start the transaction from the beginning, it is possible to provide the automatic transaction device that is not burdensome to the customer.

Second Embodiment

While in the first Embodiment the customer service port 10 is box-shaped, the second embodiment is different in that the customer service port is a customer service drum 30. Configuration of the automatic transaction device 100 related to the second embodiment is the same as the configuration shown in FIG. 1 except that the customer service port 10 is the customer service drum 30 as the bill holding unit and, thus, description thereof is omitted. The customer service drum 30 is a unit that discharges bills to a customer and accepts bills inserted by the customer.

Figure 8:
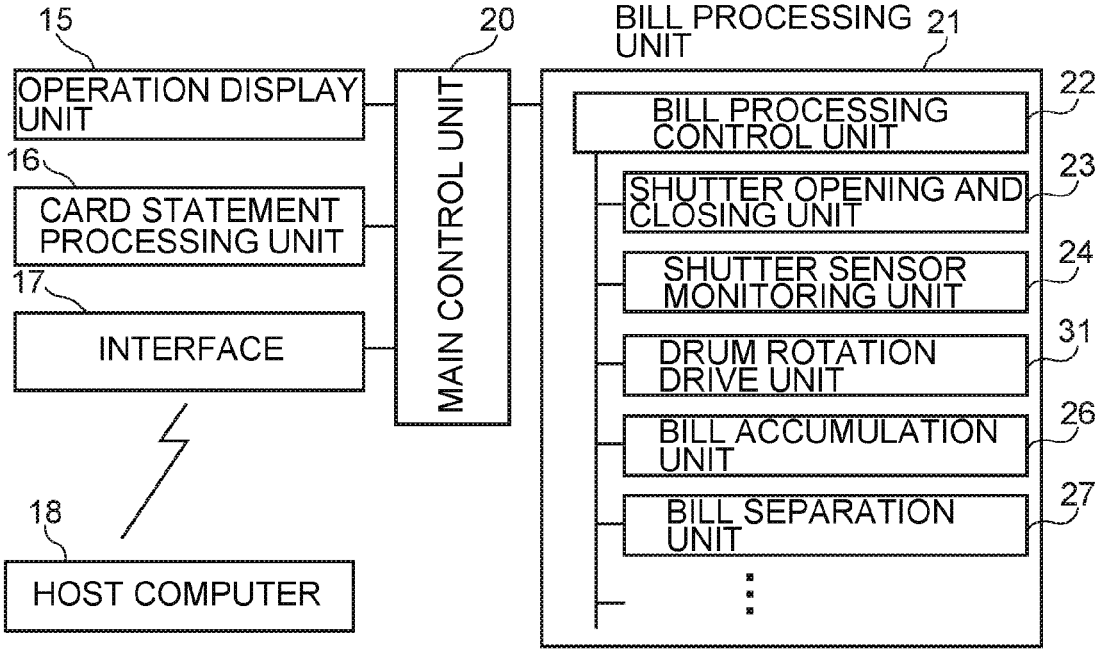
FIG. 8 illustrates a block diagram of a control system of an automatic transaction device according to a second embodiment.

FIG. 8 illustrates a block diagram of a control system of an automatic transaction device according to a second embodiment. Here, description is given only regarding elements that are different from those of the control system of the automatic transaction device 100 of the first embodiment. The bill processing unit 21 performs transporting, accumulation and holding of withdrawal bills from the bill storage 12 to the customer service drum 30, and performs feeding-out of deposit bills from the customer service drum 30, transporting, and storage thereof. The shutter opening and closing unit 23 drives the opening and closing of a shutter 32 that is described below. The shutter sensor monitoring unit 24 monitors the on-off of the shutter sensor 34 for detecting opening and closing of the shutter 32. In the present embodiment, in a case in which the shutter sensor 34 does not detect the opening despite the shutter opening and closing unit 23 having driven the shutter 32 open, the bill processing control unit 22 determines that there is an open abnormality.

A drum rotation drive unit 31 drives rotation of the customer service drum 30 as the bill holding unit. A bill accumulation unit 26 performs rotation driving of a pair of bill accumulation rollers 36-1 and 36-2 of a bill accumulation port 36 that is described below. A bill separation unit 27 performs rotation driving of bill separation rollers 37-1 through 37-3 of a bill separation port 37 that is described below.

Figure 9:
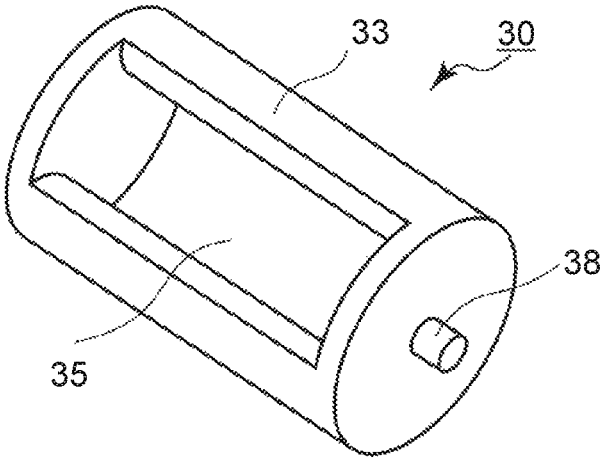
FIG. 9 is an appearance diagram illustrating a customer service drum of the automatic transaction device according to the second embodiment.
Figure 10A:
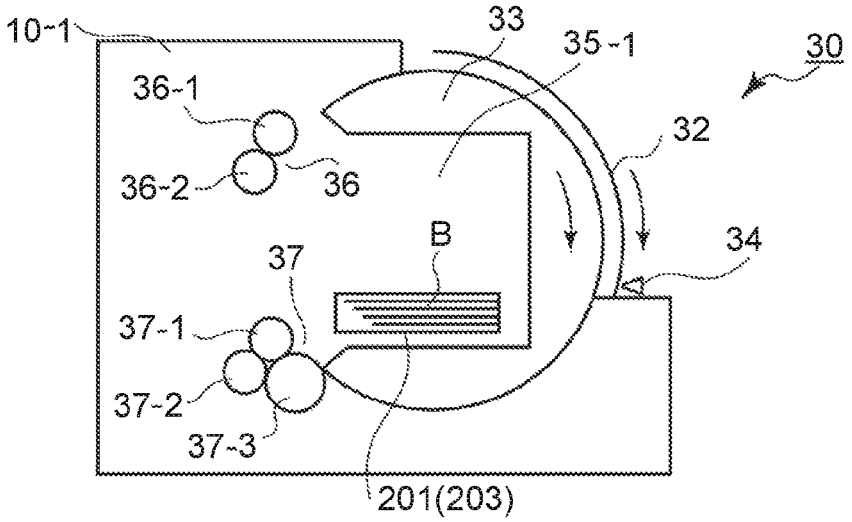
FIG. 10A is an explanatory diagram illustrating the operation of the customer service drum according to the second embodiment.
Figure 10B:
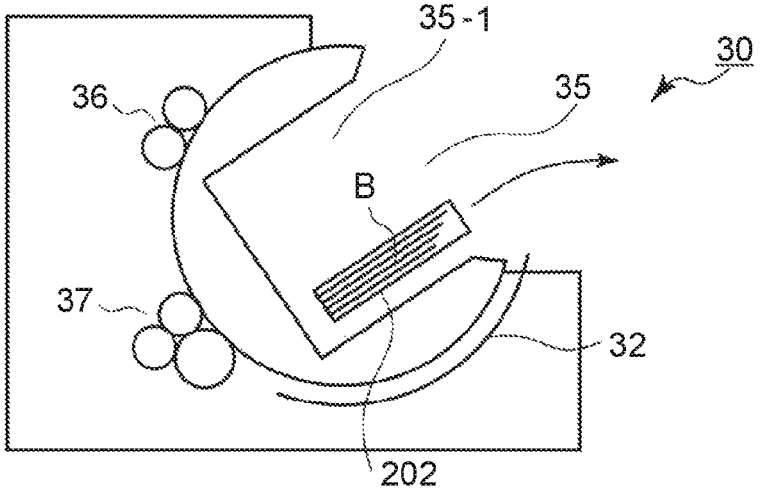
FIG. 10B is an explanatory diagram illustrating the operation of the customer service drum according to the second embodiment.

FIG. 9 is an appearance diagram illustrating the customer service drum of the automatic transaction device according to the second embodiment. The customer service drum 30 as the bill holding unit for holding accumulated bills is configured by a hollow cylindrical unit 33 arranged laterally. The cylindrical unit 33 is partially formed with an opening, which is a deposit/withdrawal port 35 for discharge and acceptance of the bills B, which is described later. Further, a support shaft 38 is formed at both ends of the customer service drum 30. By the driving force from the drum rotation drive unit 31 being transmitted to the support shaft 38, the customer service drum 30 is rotated about the support shaft 38. Further, as described below, a bill insertion chamber 35-1 into which the bills B are placed is formed in a hollow of the customer service drum 30. As shown in FIG. 10A and FIG. 10B, the shutter 32 is provided on the customer side of the customer service the drum 30. The shutter 32 has an arcuate shape, and is opened and closed by moving along the circumference of the customer service drum 30. When the shutter 32 is closed, the shutter 32 closes the deposit/withdrawal port 35 of the customer service drum 30.

FIG. 10A and FIG. 10B are explanatory diagrams illustrating the operation of the customer service drum according to the second embodiment. FIG. 10A shows an accumulation state in withdrawal operation. When performing the withdrawal operation, the customer service drum 30 is rotated and is stopped at a position such that the deposit/withdrawal port 35 opposes the bill accumulation port 36 and the bill separation port 37 at the bill conveyance path 11 side. At this time, the position of the customer service drum 30 is at an accumulation position 201. The withdrawal bills B conveyed along the bill conveyance path 11 are accumulated one by one at the accumulation position 201 of the bill insertion chamber 35-1 by the pair of bill stacking rollers 36-1 and 36-2 of the bill accumulation port 36. At this time point, the shutter 32 for closing the deposit/withdrawal port 35 of the customer service drum 30 is closed, and since the deposit/withdrawal port 35 is facing the bill conveyance path 11 that is at an opposite direction, it is impossible to access the withdrawal bills B from the customer side.

FIG. 10B shows a receiving state in the withdrawal operation. After a predetermined number of the withdrawal bills B are accumulated, the shutter 32 blocking the deposit/withdrawal port 35 is opened, and, at the same time, the deposit/withdrawal port 35 of the customer service drum 30 is opened by rotation of the customer service drum 30. At this time, the position of the customer service drum 30 is at a bill delivery position 202. Thus, as shown in FIG. 10B, the withdrawal bills B become accessible from the customer side, and the customer may receive the withdrawal bills B.

At the time of deposit, after the shutter 32 is opened, if there is an insertion of deposited bills B, the shutter 32 is closed. The customer service drum 30 is rotated in a state where the shutter 32 is closed, is stopped at a position such that the deposit/withdrawal port 35 faces the bill accumulation port 36 and the bill separation port 37. Thereafter, by the rotation of the bill separation rollers 37-1 through 37-3 in the bill separation port 37, the deposited bills B are conveyed to the bill conveyance path 11.

Figure 11:
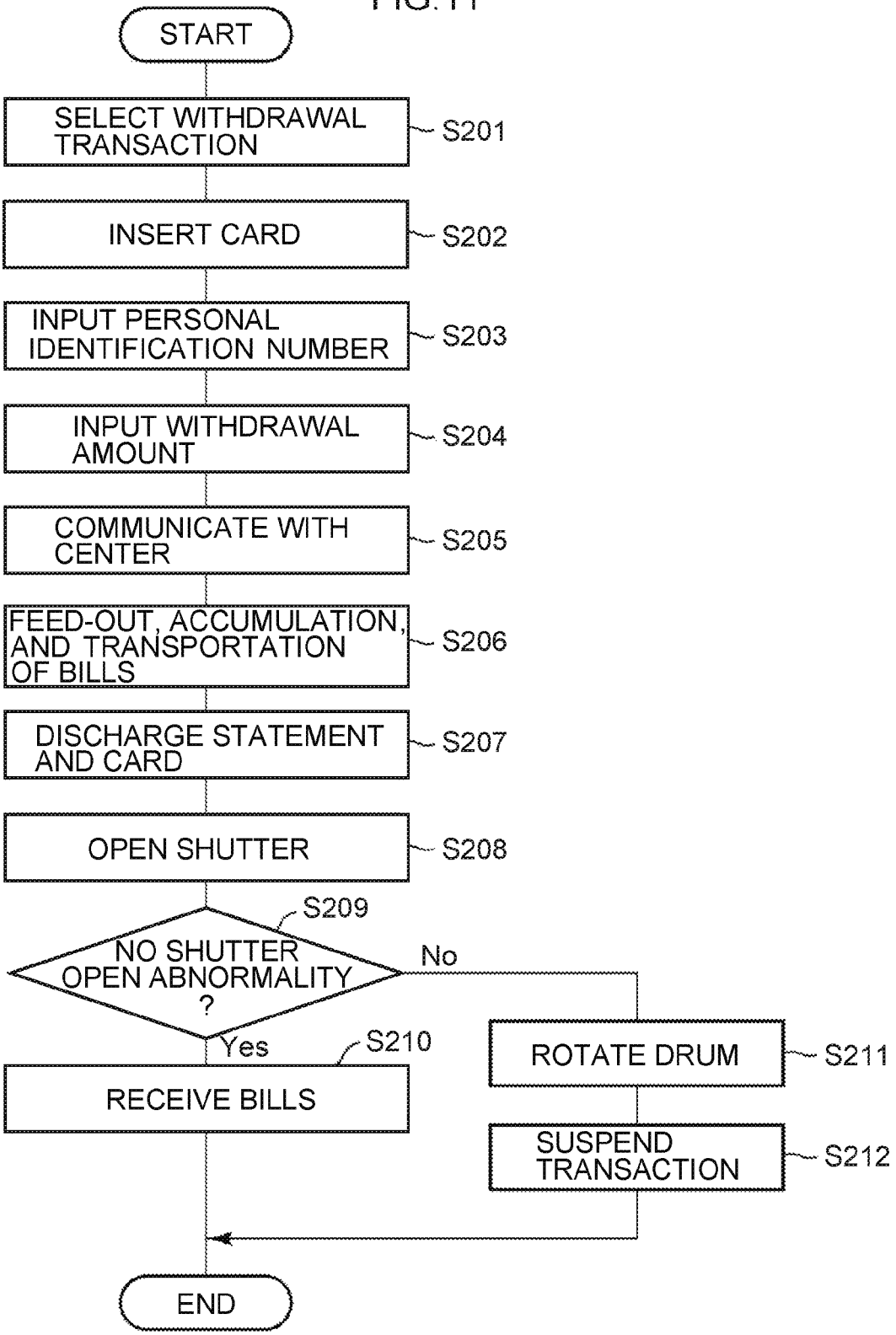
FIG. 11 is a flowchart illustrating the operation of the automatic transaction device according to the second embodiment.

FIG. 11 is a flowchart illustrating the operation of the automatic transaction device according to the second embodiment. S201 to S205: these are the same as steps 101 to 105 in the first embodiment and, thus, description thereof is omitted.

S206: After receiving indication of transaction authorization from the host computer 18, the main control unit 20 instructs the bill processing control unit 22 to perform withdrawal processing. The bill processing control unit 22 instructs the bill storages 12 to feed-out withdrawal bills that corresponds to a withdrawal amount. The withdrawal bills are conveyed along the bill conveyance path 11 and reach the customer service drum 30. The bill processing control unit 22 instructs the bill accumulation unit 26 to accumulate the bills in the customer service drum 30 by the pair of bill stacking rollers 36-1 and 36-2 of the bill accumulation port 36, and to hold them therein. After a predetermined number of the withdrawal bills B are accumulated and held at the accumulation position 201 of the customer service drum 30 as shown in FIG. 10A, the main control unit 20 instructs the bill processing control unit 22 to rotate the customer service drum 30 by driving the drum rotation drive unit 31 and to direct the deposit/withdrawal port 35 toward the customer side. In this state, the shutter 32 is closed. In this state, the withdrawal bills B are at the bill delivery position 202. Preparations to withdraw the withdrawal bills B to the customer are completed. In this state, the process transitions to the next step.

S207: The main control unit 20 instructs the card statement processing unit 16 to discharge a statement of the transaction and the cash card of the customer. A sensor (not shown) detects that the customer has received the statement of the transaction and the cash card.

S208: Then, the main control unit 20 instructs the bill processing control unit 22 to open the shutter 32 by driving the shutter opening and closing unit 23.

S209: The main control unit 20 instructs the bill processing control unit 22 to monitor, by using the shutter sensor monitoring unit 24, whether or not the shutter 32 has been normally opened. FIG. 10B shows that the shutter 32 has been opened normally. By the shutter 32 having been normally opened, the customer is able to access the withdrawal bills B in the bill delivery position 202. In this case, the process proceeds to step 210.

S210: The main control unit 20 instructs the bill processing control unit 22 to monitor that the customer receives the withdrawal bills B of the customer service port 10 by a bill sensor (not shown). After the customer receives the withdrawal bills B, the process ends.

Figure 12:
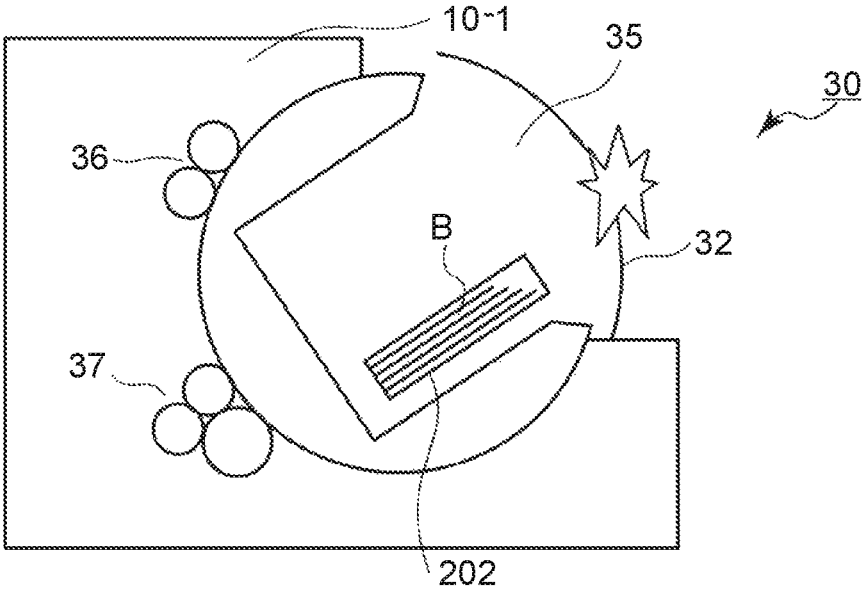
FIG. 12 is an explanatory diagram illustrating the operation in an abnormal state of the customer service drum of the automatic transaction device according to the second embodiment.

S211: As a result of detection of the shutter sensor 34, there is a case in which the shutter 32 has not been opened normally. FIG. 12 illustrates the operation in the abnormal state of the customer service drum of the automatic transaction device according to the second embodiment. In this state, the withdrawal bills B are at the bills delivery position 202. At this stage, at step 208, the bill processing control unit 22 drives the shutter opening and closing unit 23, and controls to open the shutter 32. FIG. 12 shows a state in which the shutter 32 is not opened for some reason despite the shutter opening and closing portion 23 having been driven. That is, FIG. 12 shows a state of open abnormality. At this time, the deposit/withdrawal port 35 of the customer service drum 30 is facing toward the customer side. Therefore, if an unauthorized person forcibly breaks open the shutter 32, it is possible to easily access the withdrawal bills B in the customer service drum 30. That is, the customer service drum 30 at this time is in a state in which the withdrawal bills B are accessible from the customer side.

Accordingly, in a case in which the shutter sensor 34 detects that the shutter 32 is not opened, the shutter sensor monitoring unit 24 informs the bill processing control unit 22 of this. In response to this, the bill processing control unit 22 determines that the shutter 32 in in a state of not being opened despite the opening operation, i.e., determines that there is an open abnormality, and notifies the main control unit 20. In response to this, the main control unit 20 instructs the bill processing control unit 22 to rotate the customer service drum 30 by driving the drum rotation drive unit 31. The main control unit 20 instructs the bill processing control unit 22 to cause the deposit/withdrawal 35 face toward the bill conveyance path 11 side, which serves as a retracted position 203 for retracting the withdrawal bills B.

The state in which the deposit/withdrawal port 35 faces toward the bill conveyance path 11 side is shown in FIG. 10A described above. In this state, the retracted position 203 and the accumulation position 201 are the same position. However, the retracted position 203 is not necessarily the same position as the accumulation position 201. It is suffice that the cylindrical unit 33 of the customer service drum 30 is moved to the position of the shutter 32 by rotating the customer service drum 30. The retracted position 203 for retracting the withdrawal bills B is formed by closing the deposit/withdrawal port 35 of the customer service drum 30 with the cylindrical unit 33 by rotating the customer service drum 30. In other words, the customer service drum 30 at this time is in a state in which the withdrawal bills B are inaccessible from the customer side.

Even if an unauthorized person broke open the shutter 32 in this state, because the accumulated withdrawal bills B are blocked by the housing 10-1, particularly by the cylindrical unit 33 of the customer service drum 30, it is impossible to access the accumulated withdrawal bills B from the customer side. This means that there is a change in state wherein the customer service drum 30 is at the retracted position 203, which is a position where the withdrawal bills B are inaccessible from the customer side.

S212: Then, the main control unit 20 determines to suspend the transaction. Then, when the transaction resumes, since the withdrawal bills B are not taken into the device, it is possible for a clerk to hand the withdrawal bills B to the legitimate customer by controlling the main control unit 20. For the procedure of the clerk's operations, the description thereof is omitted because it is the same as in the first embodiment.

As described above, according to the second embodiment, in a case in which it is determined that there is an open abnormality of the shutter 32, by rotating the customer service drum 30 as the bill holding unit, i.e., by turning the deposit/withdrawal port 35 of the customer service drum 30 toward the bill conveyance path 11 side, the accumulation state of the withdrawal bills B in the customer service drum 30 is changed to an inaccessible state from the customer side. As a result, at the time of withdrawal, even if there is an open abnormality of the shutter 32 of the customer service port 10, withdrawal bills cannot be easily accessed from the customer side. Further, when the transaction resumes, since the customer does not need to start the transaction from the beginning, it is possible to provide an automatic transaction device that is not burdensome to the customer.

The invention claimed is:

1. An automatic transaction device, comprising:

a customer service port that accumulates and holds bills so as to be accessible from a customer side;

a shutter that closes a deposit/withdrawal port of the customer service port;

a sensor that detects an abnormality of the shutter;

a bill holding unit that holds accumulated bills, and changes a state in the customer service port from a state in which the bills can be accessed from the customer side, to an inaccessible state in which the bills are inaccessible from the customer side; and a control unit that controls a change of state of the bill holding unit and an opening and closing operation of the shutter, wherein, in a case in which an abnormality of the shutter is detected, the control unit changes the state of the bill holding unit to the inaccessible state.

2. The automatic transaction device according to claim 1, wherein the abnormality of the shutter is an abnormality in opening of the shutter.

3. The automatic transaction device according to claim 1, wherein:

the bill holding unit comprises a rotatable cylindrical customer service drum that holds the bills therein, the customer service drum having the deposit/withdrawal port at a portion in a circumferential direction of the customer service drum, and the change of the bill holding unit to the inaccessible state comprises closing, by a cylindrical portion, the deposit/withdrawal port of the customer service drum by rotating the customer service drum.

4. The automatic transaction device according to claim 3, wherein the abnormality of the shutter is an abnormality in opening of the shutter.

5. The automatic transaction device according to claim 1, wherein the shutter is a dual shutter including a device side shutter and a customer side shutter.

6. The automatic transaction device according to claim 5, wherein the abnormality of the shutter is an abnormality in opening of the shutter.

7. The automatic transaction device according to claim 5, wherein:

the bill holding unit comprises a plurality of bill press units for holding bills collaterally, and in a case in which the sensor detects an abnormality of the customer side shutter, the change to the inaccessible state comprises moving the bill press units to a retracted position for retracting the bills.

8. The automatic transaction device according to claim 7, wherein the abnormality of the shutter is an abnormality in opening of the shutter.

9. The automatic transaction device according to claim 7, wherein the retracted position for retracting the bills is an accumulation position where the bills are accumulated.

10. The automatic transaction device according to claim 9, wherein the abnormality of the shutter is an abnormality in opening of the shutter.

11. The automatic transaction device according to claim 7, wherein the retracted position for retracting the bills is a position such that the bills held by the plurality of the bill holding units are located below the device side shutter in an opened state.

12. The automatic transaction device according to claim 11, wherein the abnormality of the shutter is an abnormality in opening of the shutter.

13. The automatic transaction device according to claim 11, wherein the retracted position for retracting the bills is a position formed by an end of the device side shutter in the opened state being overlapped by the bill holding units.

14. The automatic transaction device according to claim 13, wherein the abnormality of the shutter is an abnormality in opening of the shutter.

* * * * *